US009540582B2

(12) United States Patent
Barton et al.

(10) Patent No.: US 9,540,582 B2
(45) Date of Patent: Jan. 10, 2017

(54) METHOD OF LUBRICATING A DRIVELINE DEVICE

(75) Inventors: William R. S. Barton, Belper (GB); Gareth Brown, Belper (GB); Mark R. Baker, Midland, MI (US); Michael E. Huston, Painesville, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 239 days.

(21) Appl. No.: 13/983,913

(22) PCT Filed: Feb. 15, 2012

(86) PCT No.: PCT/US2012/025189

§ 371 (c)(1),
(2), (4) Date: Oct. 29, 2013

(87) PCT Pub. No.: WO2012/112648

PCT Pub. Date: Aug. 23, 2012

(65) Prior Publication Data

US 2015/0038385 A1 Feb. 5, 2015

Related U.S. Application Data

(60) Provisional application No. 61/443,335, filed on Feb. 16, 2011.

(51) Int. Cl.

| | |
|---|---|
| ***C10M 141/08*** | (2006.01) |
| ***C10M 129/76*** | (2006.01) |
| ***C10M 159/12*** | (2006.01) |
| ***C10M 129/32*** | (2006.01) |
| ***C10M 129/40*** | (2006.01) |
| ***C10M 133/16*** | (2006.01) |
| ***C10M 145/22*** | (2006.01) |
| ***C10M 149/14*** | (2006.01) |

(52) U.S. Cl.

CPC ..... *C10M 141/08* (2013.01); *C10M 129/32* (2013.01); *C10M 129/40* (2013.01); *C10M 129/76* (2013.01); *C10M 133/16* (2013.01); *C10M 145/22* (2013.01); *C10M 149/14* (2013.01); *C10M 159/12* (2013.01); *C10M 2207/124* (2013.01); *C10M 2207/128* (2013.01); *C10M 2207/289* (2013.01); *C10M 2209/102* (2013.01); *C10M 2215/04* (2013.01); *C10M 2215/082* (2013.01); *C10M 2217/041* (2013.01); *C10M 2219/022* (2013.01); *C10M 2219/106* (2013.01); *C10M 2223/043* (2013.01); *C10N 2230/06* (2013.01); *C10N 2240/04* (2013.01); *C10N 2240/044* (2013.01); *C10N 2240/045* (2013.01); *C10N 2240/046* (2013.01)

(58) Field of Classification Search

CPC . C10M 141/08; C10M 159/12; C10M 129/32; C10M 129/40; C10M 129/76; C10M 133/16; C10M 145/22; C10M 149/14; C10M 2207/124; C10M 2207/128; C10M 2207/289; C10M 2209/102; C10M 2215/04; C10M 2215/082; C10M 2217/041; C10M 2219/022; C10M 2219/106; C10M 2223/043; C10N 2230/06; C10N 2240/04; C10N 2240/044; C10N 2240/045; C10N 2240/046

USPC ..... 508/415, 510

See application file for complete search history.

(56) References Cited

U.S. PATENT DOCUMENTS

| | | | | |
|---|---|---|---|---|
| 4,237,022 | A | 12/1980 | Barrer | |
| 4,263,167 | A * | 4/1981 | Mago | C08K 5/0008 252/391 |
| 4,326,972 | A | 4/1982 | Chamberlin, III | |
| 4,512,903 | A | 4/1985 | Schlicht et al. | |
| 4,952,328 | A | 8/1990 | Davis et al. | |
| 5,338,470 | A | 8/1994 | Hiebert et al. | |
| 2009/0298727 | A1 * | 12/2009 | Tipton | C10M 141/10 508/192 |

FOREIGN PATENT DOCUMENTS

| | | | |
|---|---|---|---|
| WO | 2005087904 | 9/2005 | |
| WO | 2006044411 | 4/2006 | |
| WO | 2007044820 | 4/2007 | |
| WO | 2008070307 | 6/2008 | |
| WO | 2010077630 | 7/2010 | |
| WO | 2010141003 | 12/2010 | |
| WO | 2011022317 | 2/2011 | |
| WO | WO 2011022263 A1 * | 2/2011 | C10M 141/08 |
| WO | WO 2011153178 A2 * | 12/2011 | C10M 159/16 |

OTHER PUBLICATIONS

Written Opinion of Corresponding International Application No. PCT/2012/025189 dated Aug. 28, 2012.

Corresponding International Publication No. WO 2012/112648 A2 Published Aug. 8, 2012.

* cited by examiner

*Primary Examiner* — James Goloboy

(74) *Attorney, Agent, or Firm* — Deron A. Cook, Esq.; Teresan W. Gilbert, Esq.

(57) ABSTRACT

The invention provides a method of lubricating a mechanical device by supplying a lubricating composition containing an oil of lubricating viscosity and a compound having 2 to 20 hydroxy-carboxylic acid residues. The invention further relates to the use of the compound in a driveline device to provide at least one of antiwear performance, friction modification (particularly for enhancing fuel economy).

20 Claims, No Drawings

METHOD OF LUBRICATING A DRIVELINE DEVICE

FIELD OF INVENTION

The invention provides a method of lubricating a mechanical device by supplying a lubricating composition containing an oil of lubricating viscosity and a compound having 2 to 20 hydroxy-carboxylic acid residues or repeat units. The invention further relates to the use of the compound in a driveline device to provide at least one of antiwear performance, friction modification (particularly for enhancing fuel economy).

BACKGROUND OF THE INVENTION

One of the important parameters influencing durability or wear resistance of devices employing a lubricating composition is the effectiveness of phosphorus antiwear or extreme pressure additives at providing devices with appropriate protection under various conditions of load and speed. However, many of the phosphorus antiwear or extreme pressure additives contain sulphur. Due to increasing environmental concerns, the presence of sulphur in antiwear or extreme pressure additives is becoming less desirable. In addition, many of the sulphur-containing antiwear or extreme pressure additives evolve volatile sulphur species, resulting in lubricating compositions containing antiwear or extreme pressure additives having an odour, which may also be detrimental to the environment or evolve emissions that may be higher than increasingly tighter health and safety legislation specifies.

A lubricating composition having the correct balance of phosphorus antiwear or extreme pressure additives provides driveline power transmitting devices with prolonged life and efficiency with controlled deposit formation and oxidation stability. However, many of the antiwear or extreme pressure additives employed have at least one of (i) limited extreme pressure and antiwear performance over a wide range of operating conditions, (ii) limited oxidative stability, (iii) form deposits, or (iv) cause corrosion (for example copper corrosion). In addition, many phosphorus antiwear or extreme pressure additives typically contain sulphur, which results in an odorous lubricating composition containing the phosphorus antiwear or extreme pressure additives. A number of references disclosing antiwear chemistry are discussed below.

U.S. Pat. No. 5,338,470 discloses alkylated citric acid derivatives obtained as a reaction product of citric acid and an alkyl alcohol or amine. The alkylated citric acid derivative is effective as an antiwear agent and friction modifier.

U.S. Pat. No. 4,237,022 discloses tartrimides useful as additives in lubricants and fuels for effective reduction in squeal and friction as well as improvement in fuel economy.

U.S. Pat. No. 4,952,328 discloses lubricating oil compositions for internal combustion engines, comprising (A) oil of lubricating viscosity, (B) a carboxylic derivative produced by reacting a succinic acylating agent with certain amines, and (C) a basic alkali metal salt of sulphonic or carboxylic acid.

U.S. Pat. No. 4,326,972 discloses lubricant compositions for improving fuel economy of internal combustion engines. The composition includes a specific sulphurised composition (based on an ester of a carboxylic acid) and a basic alkali metal sulphonate.

International Patent application WO 2008/070307 discloses malonate esters suitable as antiwear agents.

International publication WO 2010/141003 discloses a driveline device lubricated with a composition containing a derivative of a hydroxycarboxylic acid and a phosphorus compound that may be either (i) a hydroxy-substituted di-ester of (thio)phosphoric acid, or (ii) a phosphorylated hydroxy-substituted di- or tri-ester of (thio)phosphoric acid.

International publication WO 2005/087904 discloses lubricants containing hydroxy carboxylic acid and hydroxy polycarboxylic acid esters in combination with phosphorus-containing additives. The phosphorus-containing additives include zinc dihydrocarbyldithiophosphates and/or neutral phosphorus compounds, such as trilauryl phosphate or triphenylphosphorothionate. The lubricants are useful in engine lubricants.

International Patent application PCT/US10/045,576 (based on U.S. Patent Application 61/234,717) discloses a method of lubricating an internal combustion engine comprising supplying to the internal combustion engine a lubricating composition containing an oil of lubricating viscosity and a compound obtained/obtainable by a process comprising reacting a glycolic acid, a 2-halo-acetic acid, or a lactic acid, or an alkali or alkaline metal salts thereof, (typically glycolic acid or a 2-halo-acetic acid) with at least one member selected from the group consisting of an amine, an alcohol, and an aminoalcohol.

SUMMARY OF THE INVENTION

The objectives of the present invention include to provide at least one of antiwear performance or friction modification (particularly for enhancing fuel economy).

As used herein reference to the amounts of additives present in the lubricating composition disclosed herein are quoted on an oil free basis, i.e., amount of actives, unless otherwise indicated.

In one embodiment the present invention provides a method of lubricating a driveline device comprising supplying to the driveline device a lubricating composition comprising:

(a) an oil of lubricating viscosity and (b) a compound having 2 to 20 repeat units of a residue of a hydroxy-carboxylic acid, wherein the compound is obtained/obtainable by reacting a hydroxy-carboxylic acid with a hydrogen bonding donor capable of forming an ester or amide group with a carboxylic acid group of the hydroxy-carboxylic acid, wherein the hydrogen bonding donor may be selected from at least one member of the group consisting of an alcohol, a primary amine and a secondary amine, wherein the hydroxy-carboxylic acid may be a hydroxy-substituted carboxylic acid having 2 to 10 carbon atoms, and wherein when the hydrogen bonding donor may be a mono-ol, the mole ratio of mono-ol to the hydroxy-carboxylic acid is 1 mono-ol to greater than 1 hydroxy-carboxylic acid (i.e., 1:>1). The mole ratio of mono-ol to the hydroxy-carboxylic acid may range from 1:1.1 to 1:10, or 1:1.1 to 1:5, or 1:1.1 to 1:3, or 1:1.2 to 1:2.5, or 1:2 to 1:10, or 1:2 to 1:20.

The compound of the present invention may also be defined in a number of additional ways that similarly describe having 2 to 20 repeat units of a residue of a hydroxy-carboxylic acid. The compound may be a hydroxy-carboxylic acid that is self-condensed resulting in a material with a total number of repeat units in a sequence of 2 to 20. Alternatively, the compound may have a total number of hydroxy-carboxylic acid residues (or units) ranging from 2 to 20 that have one or multiple points of attachment onto an alcohol, a primary amine and a secondary amine (typically a diol, a triol, a polyol, an aminoalcohol, a diamine, a triamine or polyamine).

In one embodiment the present invention provides a method of lubricating a driveline device comprising supplying to the driveline device a lubricating composition comprising:

(a) an oil of lubricating viscosity and (b) a compound having 2 to 20 repeat units of a residue of a hydroxy-carboxylic acid, wherein the compound is obtained/obtainable by reacting a hydroxy-carboxylic acid with a hydrogen bonding donor capable of forming an ester or amide group with a carboxylic acid group of the hydroxy-carboxylic acid, wherein the hydrogen bonding donor may be selected from at least one member of the group consisting of a diol, a triol, a polyol, and an aminoalcohol, wherein the hydroxy-carboxylic acid may be a hydroxy-substituted carboxylic acid having 2 to 10 carbon atoms, and wherein the mole ratio of the hydrogen bonding donor to the hydroxy-carboxylic acid ranges from 1:1 to 1:10, or 1:1.5 to 1:5, or 1:2 to 1:10, or 1:2 to 1:3.

The compound of the invention may be present at 0.01 wt % to 3 wt %, or 0.01 wt % to 1 wt %, or 0.03 wt % to 1 wt %, or 0.05 wt % to 0.8 wt % (typically 0.05 wt % to 0.7 wt %) of the lubricating composition.

The driveline device may be an axle or a manual transmission. The manual transmission may or may not contain a synchronizer system. In one embodiment the manual transmission does contain a synchronizer system. In one embodiment the manual transmission does not contain a synchronizer system.

In one embodiment the invention provides for the use of a compound disclosed herein in a lubricant as antiwear agent or friction modifier for a driveline device (typically an axle, a gearbox or a manual transmission).

DETAILED DESCRIPTION OF THE INVENTION

The present invention provides a method of lubricating a driveline device and a use as disclosed above.

Hydroxy-Substituted Carboxylic Acid

The hydroxy-substituted carboxylic acid may be aromatic or non-aromatic. In one embodiment the hydroxy-substituted carboxylic may be aromatic. In one embodiment the hydroxy-substituted carboxylic may be non-aromatic.

The hydroxy-carboxylic acid may have 1 to 10, or 1 to 6, or 1 to 4 hydroxyl groups. In one embodiment the hydroxy-carboxylic acid may have 2 hydroxyl groups. The hydroxy-carboxylic acid may have one hydroxy group.

The hydroxy-carboxylic acid may contain one hydroxyl group and one or two carboxylic acid moieties.

The number of carbon atoms of the hydroxy-carboxylic acid may vary from 2 to 8, or 2 to 6, or 2 to 4, or 2 to 3. In one embodiment the number of carbon atoms of the hydroxy-carboxylic acid may be 2 to 3.

As used herein reference to "a" specific compound such as "a glycolic acid", or "a malic acid" and so on is intended to include both the chemical itself i.e., glycolic acid, malic acid, and substituted equivalents thereof.

The hydroxy-carboxylic acid may be selected from the group consisting of a glycolic acid, a malic acid, a salicylic acid, a mandelic acid, or a lactic acid, a tartaric acid, a citric acid; and mixtures thereof, and derivatives (such as an alkali or alkaline metal salt) thereof. The hydroxy-carboxylic acid may optionally be substituted with amino, halo, or $C_{1-7}$ hydrocarbyl groups.

The hydroxy-carboxylic acid may be selected from the group consisting of glycolic acid, malic acid, salicylic acid, mandelic acid, or lactic acid, tartaric acid, citric acid; and mixtures thereof, and derivatives (such as an alkali or alkaline metal salt) thereof.

The hydroxy-carboxylic acid may be glycolic acid or mixtures thereof.

The compound may have 2 to 10, or 2 to 5 repeat units of a residue of a hydroxy-carboxylic acid. In one embodiment the compound may have 2 to 3 repeat units of a residue of a hydroxy-carboxylic acid.

Hydrogen Bonding Donor

As used herein the expression "hydrogen bonding donor" is intended to include compounds that have a hydrogen atom capable of being attracted to an electronegative atom (such as nitrogen oxygen, or fluorine). Typically the hydrogen bonding donor is attracted to an electronegative atom in another molecule.

The hydrogen bonding donor may be an alcohol, an amine, or an aminoalcohol.

Alcohol

The alcohol may include a mono-ol, a diol, a triol, or higher polyol, or mixtures thereof. The alcohol may include a variety of alcohols having 4 to 30, or 6 to 20, or 8 to 18 carbon atoms. The alcohol may be a linear, a cyclic aromatic, or non-aromatic alcohol. A linear alcohol may be a hydroxy-alkyl alcohol, an alkoxy alcohol or a phenoxy alcohol.

The alcohol may be a mono-ol, a diol, a triol, or tetrol, typically a mono-ol, or diol. The alkyl alcohol may include butanol, 2-methylpentanol, 2-propylheptanol, 2-butyloctanol, 2-ethylhexanol, octanol, nonanol, isooctanol, isononanol, 2-tert-butylheptanol, 3-isopropylheptanol, decanol, undecanol, 5-methylundecanol, dodecanol, 2-methyldodecanol, tridecanol, 5-methyl-tridecanol, tetradecanol, pentadecanol, hexadecanol, 2-methylhexadecanol, heptadecanol, 5-isopropylheptadecanol, 4-tert-butyloctadecanol, 5-ethyl-octa-decanol, 3-isopropyloctadecanol, octadecanol, nonadecanol, eicosanol, cetyleicosanol, stearyleicosanol, docosanol and/or eicosyltetratriacontanol. Other useful mono-ol may include oleyl alcohol, stearyl alcohol, coco alcohol, tallow alcohol, or mixtures thereof.

Commercially available alcohols may include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810, Alfol® 1214 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

As used herein, the expression "higher polyol" is intended to include compounds with 4 or more hydroxyl groups. The polyol may, for example, include a compound having 4, or 5 or 6 hydroxyl groups The reaction diol, triol or tetrol may include 1,2,7,8-octanetetraol, 2-butyl-1,3-octanediol, 2-butyl-1,3-nonanediol, 1,2,3-heptanetriol, 1,2-butanediol, neopentyl glycol, pentaerythritol, trimethylolpropane, 1,2-hexanediol, 1,2-octanediol, 1,2,decanediol, 1,2-dodecanediol, 1,2-decanediol, 1,2-tetradecanediol, 1,2-hexadecanediol, 1,2-octadecanediol, 1,2-eicosanediol, 2-ethyl-1,3-hexanediol, 2-butyl-2-ethyl-1,3-propanediol, glycerine or ethylene glycol, or mixtures thereof.

The alkoxy alcohol or phenoxy alcohol may include oleyl ethoxylate, lauryl ethoxylate, stearyl ethoxylate, coco ethoxylate, tallow ethoxylate, oleyl propoxylate, lauryl propoxylate, stearyl propoxylate, coco propoxylate, tallow propoxylate, phenyl ethoxylate, tert-butyl phenyl ethoxylate, tert-butyl phenyl propoxylate, or mixtures thereof.

Amine

The amine may be a primary or secondary amine. The amine may be a monoamine or a polyamine. The monoamine may include a variety of amines having 4 to 30, or 6 to 20, or 8 to 18 carbon atoms.

The monoamine may be a primary amine such as butylamine, 2-methylpentamine, 2-propylheptamine, 2-butyloctamine, 2-ethylhexamine, octamine, nonamine, isooctamine, isononamine, 2-tert-butylheptamine, 3-isopropylheptamine, decamine, undecamine, 5-methylundecamine, dodec-amine, 2-methyldodecamine, tridecamine, 5-methyltridecamine, tetradecamine, pentadecamine, hexadecamine, 2-methylhexadecamine, heptadecamine, 5-ethyl-octadecamine, octadecamine, nonadecamine, eicosamine, cetyleicosamine, stearyleicosamine, docosamine and/or eicosyltetratriacontamine. Other useful monoamines include oleyl amine, stearyl amine, coco amine, tallow amine, or mixtures thereof.

The monoamine may be a secondary amine di-(butyl) amine, di-(2-methylpentyl)amine, di-(2-propylheptyl) amine, di-(2-butyloctyl)amine, di-(2-ethylhexyl)amine, di-(octyl)amine, di-(nonyl)amine, di-(isooctyl)amine, di-(isononyl)amine, di-(3-isopropylheptyl)amine, di-(decyl) amine, di-(undecyl)-amine, di-(5-methylundecyl)amine, di-(dodecyl)amine, di-(2-methyldodecyl)-amine, di-(tridecyl) amine, di-(5-methyltridecyl)amine, di-(tetradecyl)amine, di-(pentadecyl)amine, di-(heptadecyl)amine, di-(5-isopropylheptadecyl)amine, di-(5-ethyloctadecyl)amine, di-(3-isopropyloctadecyl)amine, di-(octadecyl)amine, di-(nonadecyl)amine, di-(eicosyl)amine, di-(cetyleicosyl) amine, di-(stearyl-eicosyl)amine, or di-(docosyl)amine, or mixtures thereof.

Aminoalcohol

The aminoalcohol may include ethanolamine, isopropanolamine, diethanolamine, triethanolamine, diethylethanolamine, dimethylethanolamine, dibutylethanolamine, 3-amino-1,2-propanediol; serinol; 2-amino-2-methyl-1,3-propanediol; tris(hydroxymethyl)-aminomethane; N-methylglucamine, 1-amino-1-deoxy-D-sorbitol; diethanol amine; diisopropanolamine; N-methyl-N,N-diethanol amine; triethanolamine; N,N,N',N'-tetrakis(2-hydroxypropyl)ethylenediamine, 2-amino-2-methyl-1-propanol, 2-dimethylamino-methyl-1-propanediol, 2-amino-2-ethyl-1,3-propane diol, 2-amino-2-methyl-1,3-propanediol, 2-amino-1-butanol and mixtures thereof.

Polyamine

The amine may also include a polyamine, or mixtures thereof. The polyamine may be an alkylene polyamine, or mixtures thereof. The alkylene polyamine may be an ethylene polyamine, propylene polyamine, butylene polyamine, or mixtures thereof. Typically the polyamine may be an ethylene polyamine, or mixtures thereof. Ethylene polyamines, such as some of those mentioned above, are preferred. They are described in detail under the heading "Diamines and Higher Amines" in Kirk Othmer's "Encyclopedia of Chemical Technology", 4th Edition, Vol. 8, pages 74-108, John Wiley and Sons, N.Y. (1993) and in Meinhardt, et al, U.S. Pat. No. 4,234,435.

Examples of ethylene polyamine include ethylenediamine, diethylenetriamine, triethylenetetramine, tetraethylenepentamine, pentaethylene-hexamine, N-(2-aminoethyl)-N'-[2-[(2-aminoethyl)amino]ethyl]-1,2-ethanediamine, alkylene polyamine still bottoms, or mixtures thereof.

The alkylene polyamine bottoms may be characterized as having less than 2%, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex., designated "E-100" has a specific gravity of 1.0168 g/cm$^3$ at 15.6° C., a percent nitrogen by weight of 33.15 and a viscosity at 40° C. of 121 cSt (mm$^2$/s). Gas chromatography analysis of such a sample shows it contains about 0.93% "Light Ends" (most probably diethylenetriamine), 0.72% triethylenetetramine, 21.74% tetraethylene pentamine and 76.61% pentaethylene hexamine and higher (by weight). A similar alkylene polyamine bottoms is commercially sold under as E100™ polyethyleneamines from Dow Chemical.

The compound as described herein may in some embodiments be obtained/obtainable by a process comprising reacting a hydroxy-substituted carboxylic acid with a monoalcohol or mono-amine. A typically prepared compound of this type may be similar to a compound represented by Formula (1) (see below).

The compound as described herein may also be obtained/obtainable by reacting a glycolic acid, a 2-halo-acetic acid, or a lactic acid, or an alkali or alkaline metal salt thereof (typically glycolic acid or a 2-halo-acetic acid) with at least one amine or alcohol, wherein the alcohol may be a diol, a triol or a higher polyol, and wherein the amine may be a diamine, a triamine, or higher polyamine. The alcohol or amine component may also include one or more monoalcohols or monoamines. Typically, a compound of this type may be similar to a compound represented by Formula (2) (see below).

Compound of Formula (1) to Formula (3)

In one embodiment the compound as obtainable/obtained by the process described herein may be represented by a compound of Formula (1), or mixtures thereof. In one embodiment the compound obtained by the process described herein may be represented by Formula (2), or mixtures thereof. In one embodiment the compound obtained by the process described herein may be represented by Formula (3), or mixtures thereof.

The compounds that may be obtained/obtainable by the process described herein may be represented by one or more of Formula (1) or Formula (2) or Formula (3):

Formula (1)

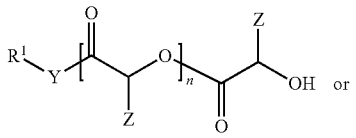

or

Formula (2)

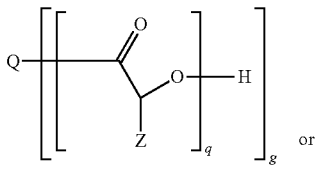

or

-continued

Formula (3)

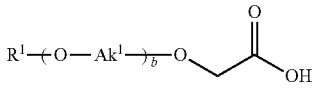

wherein

Y may independently be oxygen or >NH or >NR[1];

R[1] may independently be a hydrocarbyl group, typically containing 4 to 30, or 6 to 20, or 8 to 18 carbon atoms;

Z may independently be hydrogen or methyl (when Z=hydrogen, the compound may be derived from glycolic acid, when Z=methyl, the compound may be derived from lactic acid; typically Z may be hydrogen);

Q may independently be the residue of a diol, triol or higher polyol, a diamine, triamine, or higher polyamine, or an aminoalcohol (typically Q may be a diol, diamine or amino-alcohol and may contain an internal ether linkage);

g may independently be 2 to 6, or 2 to 3, or 2;

q may independently be 1 to 4, or 1 to 3 or 1 to 2;

n may independently be 0 to 10, 0 to 6, 0 to 5, 1 to 4, or 1 to 3 (when n is above 0, the compound may be described as a dimer (when n=1), a trimer (when n=2), or a higher oligomer (when n=3 to 10)). In one embodiment n may be 1 to 4, or 1 to 3. In one embodiment n=1 and the compound may be a dimer; and Ak[1] may independently be an alkylene group containing 1 to 5, or 2 to 4 or 2 to 3 carbon atoms (typically ethylene); and b may independently be 1 to 10, or 2 to 8, or 4 to 6, or 4.

In one embodiment the invention provides a method of lubricating a driveline device comprising supplying to the driveline device a lubricating composition comprising an oil of lubricating viscosity and represented by one or more of Formula (1) or Formula (2) or Formula (3) as described above.

A compound of Formula (1) may define n to be 1 to 10, 1 to 6, 1 to 5, 1 to 4, or 1 to 3.

The compound prepared by the process disclosed herein may be considered to be the same as those derivable from Formula (1) or Formula (2). In one embodiment the alcohol may be a monoalcohol, or diol, or wherein the amine may be a mono-amine or a polyamine (typically a diamine), or an aminoalcohol. Typically the diol, diamine or aminoalcohol have hydroxy or amino groups attached to carbon atoms in such a way to allow for 1,2- 1,3-, or 1,4- (typically 1,2- or 1,3-) substitution.

In different embodiments the compound of Formula (1) or Formula (2) may have Z equal to hydrogen, or n may be 0 to 5, 1 to 4, or 1 to 3, or R[1] may be an alk(en)yl group, or a cycloalkyl group.

In one embodiment the compound of Formula (1) may have Z equal to hydrogen and n may be 1 to 4, or 1 to 3.

In one embodiment the compound of Formula (1) to Formula (3) may be substantially composed of carbon, oxygen, nitrogen and hydrogen.

In one embodiment the compound of Formula (1) to Formula (3) may not contain sulphur or phosphorus.

In one embodiment the compound of Formula (1) may represented by Formula (1a):

Formula (1a)

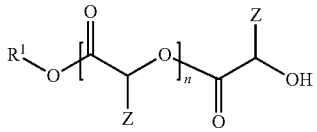

wherein

R[1] may independently be a hydrocarbyl group, typically containing 4 to 30, or 6 to 20, or 8 to 18 carbon atoms;

Z may be hydrogen or methyl (when Z=hydrogen, the compound may be derived from glycolic acid, when Z=methyl the compound may be derived from lactic acid); and n may be 0 to 10, 0 to 6, 0 to 5, 1 to 4, or 1 to 3.

In one embodiment the compound of Formula (1) may represented by Formula (1b):

Formula (1b)

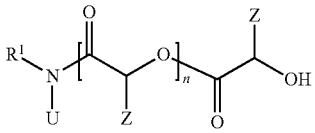

wherein

R[1] may independently be a hydrocarbyl group, typically containing 4 to 30, or 6 to 20, or 8 to 18 carbon atoms;

Z may independently be hydrogen or methyl (when Z=hydrogen, the compound may be derived from glycolic acid, when Z=methyl the compound may be derived from lactic acid);

U may independently be hydrogen or R[1]; and n may independently be 0 to 10, 0 to 6, 0 to 5, 1 to 4, or 1 to 3.

In Formula (1b) when Z=hydrogen, n=1, and U=hydrogen, the resultant compound may be represented by Formula (1b)(i):

Formula (1b)(i)

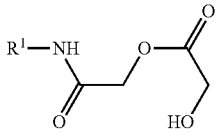

wherein R[1] may independently be a hydrocarbyl group, typically containing 4 to 30, or 6 to 20, or 8 to 18 carbon atoms.

Examples of a compound of this type include oleyl glycolamide-glycolate, stearyl glycolamide-glycolate, coco glycolamide-glycolate, tallow oleyl glycolamide-glycolate, or mixtures thereof.

In one embodiment the compound of Formula (2) may be represented by Formula (2a):

Formula (2a)

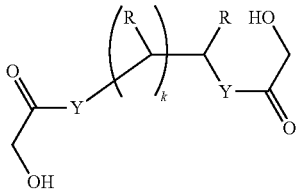

wherein each R may independently be hydrogen, or a hydrocarbyl group, typically containing 4 to 30, or 6 to 20, or 8 to 18, or 8 to 16 carbon atoms;

k may independently be 1 to 4, or 1 to 3, 1 to 2, or 1; and

Y may independently be oxygen or >NH or >$NR^1$.

In one embodiment Y may be oxygen. In Formula (2a), when Y is oxygen, the compound may be obtained by the reaction of a diol with glycolic acid. The resultant compound may be represented by Formula (2b):

Formula (2b)

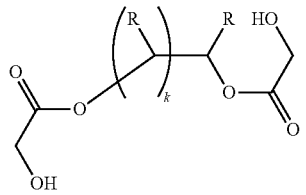

wherein k may independently be 1 to 4, or 1 to 2, or 1; and each R may independently be hydrogen, or a hydrocarbyl group, typically containing 4 to 30, or 6 to 20, or 8 to 18, or 8 to 16 carbon atoms.

For compounds of Formula (2a), these may be prepared from a diol such as a diglycolic acid ester including 1,2-dodecanediol diglycolate, 2-decanediol diglycolate, 2-tetradecanediol diglycolate, or mixtures thereof.

In one embodiment Y may be >NH or >$NR^1$. In Formula (2a), when Y is >NH or >$NR^1$, the compound may be obtained by the reaction of a diamine with glycolic acid. The resultant compound may be represented by Formula (2c):

Formula (2c)

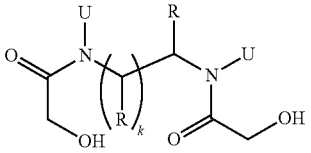

wherein

U may independently be hydrogen or $R^1$, $R^1$ may independently be a hydrocarbyl group, typically containing 4 to 30, or 6 to 20, or 8 to 18 carbon atoms;

each R may independently be hydrogen or a hydrocarbyl group, typically containing 4 to 30, or 6 to 20, or 8 to 18, or 8 to 16 carbon atoms; and k may independently be 1 to 4, or 1 to 3.

For compounds of Formula (2a), these may be prepared from a diamine such as a "Duomeen™" series amine (available from Akzo Nobel), or mixtures thereof. The Duomeen may be Duomeen T or Duomeen O. The diamine may be prepared by the addition a monoamine to acrylonitrile, followed by catalytic reduction of the resulting nitrile compound, using, e.g., $H_2$ over Pd/C catalyst, to give the diamine.

A compound of Formula (3) may be obtained from an alkoxy alcohol or phenoxy alcohol reacted with a 2-haloacetic acid (or alkali or alkaline metal salts thereof). The 2-haloacetic acid may be chloro- or bromo- or iodo-acetic acid, or mixtures thereof. The chloro- or bromo- or iodo-acetic acid may also be in the form of sodium, lithium or potassium salts thereof. In one embodiment the compound of Formula (3) may be derived from sodium 2-chloroacetate or 2-chloroacetic acid reacted with an alkoxy alcohol or phenoxy alcohol.

Compounds of the type described by Formula (3) and their preparation are disclosed in WO 2009/040370, EP 1 354 905, and EP 1 061 064 (all assigned to Clariant G.m.b.H). The compound derived from the alkoxy alcohol may include a compound represented by Formula (3a):

Formula (3a)

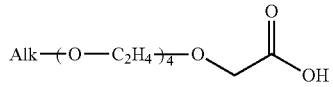

wherein the Alk group may be $C_{8-18}$ or $C_{10-18}$ alkyl or alkylene (Alk may for example include lauryl, oleyl, stearyl, tallow, coco, or mixtures thereof).

The compound derived from the alkoxy alcohol may include a compound represented by Formula (3b):

Formula (3b)

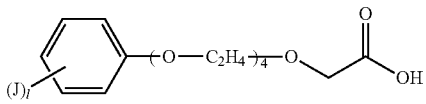

wherein J may be a linear or branched alkyl group (typically having 4 to 20, or 4 to 12, or 4 to 8 carbon atoms such as tert-butyl, or 2-ethylhexyl); and 1 may be 0 to 5, or 0 to 2, or 0 to 1.

The reaction to prepare the compound of the present invention may be performed in a variety of different reaction conditions. The reaction may be carried out at a reaction temperature in the range of 70° C. to 200° C., or 90° C. to 180° C., or 100° C. to 160° C. The reaction may be carried out in an inert atmosphere, e.g., under nitrogen or argon, typically nitrogen. The reaction may be performed in the presence or absence of a solvent (typically including a solvent). The solvent includes an aromatic hydrocarbon solvent. The reaction may be carried out in the absence or presence of catalyst (typically in the presence of a catalyst). The catalyst may include methane sulphonic acid, toluene sulphonic acid, benzene sulphonic acid, or $C_{12}H_{25}$-alkylbenzenesulphonic acid. The catalyst may also include metal salts of titanium, zirconium or aluminium that have counterions of chloride, bromide, iodide, or alkoxides (wherein alkyl group on the alkoxide may have 1 to 20, or 1 to 4 carbon atoms), or mixtures thereof. The catalyst may also include a phosphate of formula HO—$(P(O)(OH)O)_e$—H, where e may be 1 to 5, or 2 to 5. In one embodiment the catalyst may be a sulphonic acid, typically methane sulphonic acid.

Examples of an aromatic hydrocarbon solvent include aromatic hydrocarbon solvent include Shellsolv AB® (commercially available from Shell Chemical Company); and toluene extract, xylene Aromatic™ 200, Aromatic™ 150, Aromatic™ 100, Solvesso™ 200, Solvesso™ 150, Solvesso™ 100, HAN 857® (all commercially available from Exxon Chemical Company), or mixtures thereof. Other aromatic hydrocarbon solvents include xylene, toluene, or mixtures thereof.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10). In one embodiment the oil of lubricating viscosity may be an API Group II, Group III, Group IV oil, or mixtures thereof.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Organo-Sulphide

In one embodiment the lubricating composition disclosed herein further comprises an organo-sulphide, or mixtures thereof. In one embodiment the organo-sulphide comprises at least one of a polysulphide, a thiadiazole compound, or mixtures thereof.

In different embodiments, the organo-sulphide is present in a range selected from the group consisting of 0 wt % to 10 or to 8 wt %, 0.01 wt % to 10 or to 8 wt %, 0.1 wt % to 8 or to 6 wt %, and 0.25 wt % to 6 wt %; of the lubricating composition.

Thiadiazole Compound

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form oligomers of two or more of said thiadiazole units. These thiadiazole compounds may also be used in the post treatment of dispersants as mentioned below in the formation of a dimercaptothiadiazole derivative of a polyisobutylene succinimide.

Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilised. In different embodiments the number of carbon atoms on the hydrocarbyl-substituent group includes 1 to 30, 2 to 25, 4 to 20, 6 to 16, or 8 to 10.

In one embodiment, the thiadiazole compound is the reaction product of a phenol with an aldehyde and a dimercaptothiadiazole. The phenol includes an alkyl phenol wherein the alkyl group contains at least 6, e.g., 6 to 24, or 6 (or 7) to 12 carbon atoms. The aldehyde includes an aldehyde containing 1 to 7 carbon atoms or an aldehyde synthon, such as formaldehyde. Useful thiadiazole compounds include 2-alkyldithio-5-mercapto-[1,3,4]-thiadiazoles, 2,5-bis(alkyldithio)-[1,3,4]-thiadiazoles, 2-alkylhydroxyphenylmethylthio-5-mercapto-[1,3,4]-thiadiazoles (such as 2-[5-heptyl-2-hydroxyphenylmethylthio]-5-mercapto-[1,3,4]-thiadiazole), and mixtures thereof.

In one embodiment the thiadiazole compound includes at least one of 2,5-bis(tert-octyldithio)-1,3,4-thiadiazole, 2,5-bis(tert-nonyldithio)-1,3,4-thiadiazole, or 2,5-bis(tert-decyldithio)-1,3,4-thiadiazole.

Polysulphide

In one embodiment at least 50 wt % of the polysulphide molecules are a mixture of tri- or tetra-sulphides. In other embodiments at least 55 wt %, or at least 60 wt % of the polysulphide molecules are a mixture of tri- or tetra-sulphides.

The polysulphide includes a sulphurised organic polysulphide from oils, fatty acids or ester, olefins or polyolefins.

Oils which may be sulfurized include natural or synthetic oils such as lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulphurised fatty acid esters prepared from mixed unsaturated fatty acid esters such as are obtained from animal fats and vegetable oils, including tall oil, linseed oil, soybean oil, rapeseed oil, and fish oil.

The polysulphide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulphurised olefin includes an olefin derived from propylene, isobutylene, pentene or mixtures thereof.

In one embodiment the polysulphide comprises a polyolefin derived from polymerising, by known techniques, an olefin as described above.

In one embodiment the polysulphide includes dibutyl tetrasulphide, sulphurised methyl ester of oleic acid, sulphurised alkylphenol, sulphurised dipentene, sulphurised dicyclopentadiene, sulphurised terpene, and sulphurised Diels-Alder adducts.

Other Performance Additives

A lubricating composition may be prepared by adding the product of the process described herein to an oil of lubricating viscosity, optionally in the presence of other performance additives (as described herein below).

The lubricating composition of the invention optionally comprises other performance additives. The other performance additives include at least one of metal deactivators, viscosity modifiers, detergents, friction modifiers (other than the compounds disclosed herein), antiwear agents (other than the compounds disclosed herein), corrosion inhibitors, dispersants, dispersant viscosity modifiers, extreme pressure agents, antioxidants, foam inhibitors, demulsifiers, pour point depressants, seal swelling agents and mixtures thereof.

Typically, a fully-formulated lubricating oil will contain one or more of these performance additives.

Antioxidants include diarylamine alkylated diarylamines, hindered phenols, molybdenum compounds (such as molybdenum dithiocarbamates), hydroxyl thioethers, or mixtures thereof. In one embodiment the lubricating composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the lubricating composition.

The diarylamine alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, or di-decylated diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

In one embodiment the lubricating composition further includes a viscosity modifier. The viscosity modifier is known in the art and may include hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

The dispersant viscosity modifier may include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825.

In one embodiment the lubricating composition of the invention further comprises a dispersant viscosity modifier. The dispersant viscosity modifier may be present at 0 wt % to 15 wt %, or 0 wt % to 10 wt %, or 0.05 wt % to 5 wt %, or 0.2 wt % to 2 wt % of the lubricating composition.

The lubricating composition may further include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the dispersant may be present as a single dispersant. In one embodiment the dispersant may be present as a mixture of two or three different dispersants, wherein at least one may be a succinimide dispersant.

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid.

In one embodiment the dispersant may be a post treated dispersant (typically a long chain alkenyl succinimide). The dispersant may be post treated with dimercaptothiadiazole, optionally in the presence of one or more of a phosphorus compound, a dicarboxylic acid of an aromatic compound, and a borating agent. The long chain alkenyl succinimide may include polyisobutylene succinimide, wherein the polyisobutylene from which it is derived has a number average molecular weight in the range 350 to 5000, or 500 to 3000, or 750 to 1150.

In one embodiment the post treated dispersant may be formed by heating an alkenyl succinimide or succinimide detergent with a phosphorus ester and water to partially hydrolyze the ester. The post treated dispersant of this type is disclosed for example in U.S. Pat. No. 5,164,103.

In one embodiment the post treated dispersant may be produced by preparing a mixture of a dispersant and a dimercaptothiadiazole and heating the mixture above about 100° C. The post treated dispersant of this type is disclosed for example in U.S. Pat. No. 4,136,043.

In one embodiment the dispersant may be post treated to form a product prepared comprising heating together: (i) a dispersant (typically a succinimide), (ii) 2,5-dimercapto-1,3,4-thiadiazole or a hydrocarbyl-substituted 2,5-dimercapto-1,3,4-thiadiazole, or oligomers thereof, (iii) a borating agent (similar to those described above); and (iv) optionally a dicarboxylic acid of an aromatic compound selected from the group consisting of 1,3 diacids and 1,4 diacids (typically terephthalic acid), or (v) optionally a phosphorus acid compound (including either phosphoric acid or phosphorous acid), said heating being sufficient to provide a product of (i), (ii), (iii) and optionally (iv) or optionally (v), which is soluble in an oil of lubricating viscosity. The post treated dispersant of this type is disclosed, for example, in International Application WO 2006/654726 A.

The dispersant may be present at 0.01 wt % to 20 or to 10 wt %, or 0.1 wt % to 15 or to 8 wt %, or 0.1 wt % to 10 or to 7 wt %, or 1 wt % to 6 or to 7 wt %, or 1 to 3 wt % of the lubricating composition.

In one embodiment the invention provides a lubricating composition further comprising an overbased metal-containing detergent. The overbased metal-containing detergent may be a calcium or magnesium an overbased detergent.

The overbased metal-containing detergent may be selected from the group consisting of non-sulphur containing phenates, sulphur containing phenates, sulphonates, salixarates, salicylates, and mixtures thereof, or borated equivalents thereof. The overbased metal-containing detergent may be may be selected from the group consisting of non-sulphur containing phenates, sulphur containing phenates, sulphonates, and mixtures thereof. The overbased detergent may be borated with a borating agent such as boric acid such as a borated overbased calcium or magnesium sulphonate detergent, or mixtures thereof.

In one embodiment the friction modifier may be selected from the group consisting of long chain fatty acid derivatives of amines, long chain fatty esters, or derivatives of a long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. The friction modifier may be present at 0 wt % to 6 or to 5 wt %, or 0.01 wt % to 4 wt %, or 0.05 wt % to 2 wt %, or 0.1 wt % to 2 wt % of the lubricating composition.

As used herein the term "fatty alkyl" or "fatty" in relation to friction modifiers means a carbon chain having 10 to 22 carbon atoms, typically a straight carbon chain. Alternatively, the fatty alkyl may be a mono branched alkyl group, with branching typically at the β-position. Examples of mono branched alkyl groups include 2-ethylhexyl, 2-propylheptyl or 2-octyldodecyl.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulphurised fatty compounds and olefins, molybdenum dialkyldithiophosphates, molybdenum dithiocarbamates, sunflower oil or soybean oil monoester of a polyol and an aliphatic carboxylic acid.

In one embodiment the friction modifier may be a long chain fatty acid ester. In another embodiment the long chain fatty acid ester may be a mono-ester and in another embodiment the long chain fatty acid ester may be a triglyceride.

The lubricating composition optionally further includes at least one antiwear agent (other than the compound of the invention). Examples of suitable antiwear agents include titanium compounds, tartrates, tartrimides, oil soluble amine salts of phosphorus compounds, sulphurised olefins, metal dihydrocarbyldithiophosphates (such as zinc dialkyldithiophosphates [ZDDP]), phosphites (such as dibutyl phosphite), phosphonates, thiocarbamate-containing compounds, such as thiocarbamate esters, thiocarbamate amides, thiocarbamic ethers, alkylene-coupled thiocarbamates, bis(S-alkyldithiocarbamyl) disulphides, and oil soluble phosphorus amine salts. In one embodiment the lubricating composition contains a source of phosphorus such as ZDDP.

The antiwear agent may in one embodiment include a tartrate, or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8. The antiwear agent may in one embodiment include a citrate as is disclosed in US Patent Application 20050198894.

In one embodiment the oil soluble phosphorus amine salt antiwear agent includes an amine salt of a phosphorus acid ester or mixtures thereof. The amine salt of a phosphorus acid ester includes phosphoric acid esters and amine salts thereof dialkyldithiophosphoric acid esters and amine salts thereof; phosphites; and amine salts of phosphorus-containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof; and mixtures thereof. The amine salt of a phosphorus acid ester may be used alone or in combination.

In one embodiment the oil soluble phosphorus amine salt includes partial amine salt-partial metal salt compounds or mixtures thereof. In one embodiment the phosphorus compound further includes a sulphur atom in the molecule.

Examples of the antiwear agent may include a non-ionic phosphorus compound (typically compounds having phosphorus atoms with an oxidation state of +3 or +5). In one embodiment the amine salt of the phosphorus compound may be ashless, i.e., metal-free (prior to being mixed with other components). The amine salt of the phosphorus compound may be a salt as disclosed in U.S. Pat. No. 3,197,405 (sulphur-containing), or in US Patent Application 2010/0016188 (sulphur-free).

In one embodiment the hydrocarbyl amine salt of an alkylphosphoric acid ester is the reaction product of a C14 to C18 alkyl phosphoric acid with Primene 81R™ (produced and sold by Rohm & Haas, or Dow Chemicals) which is a mixture of C11 to C14 tertiary alkyl primary amines.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81 R™, and mixtures thereof.

Extreme Pressure (EP) agents that are soluble in the oil include sulphur- and chlorosulphur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulphurised olefins (such as sulphurised isobutylene), a hydrocarbyl-substituted 2,5-dimercapto-1,3,4-thiadiazole, or oligomers thereof, organic sulphides and polysulphides such as dibenzyl-disulphide, bis-(chlorobenzyl) disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbyl and trihydrocarbyl phosphites, e.g., dibutyl phosphite, diheptyl phosphite, dicyclo-hexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptyl-phenol diacid.

Foam inhibitors that may be useful in the compositions of the invention include polysiloxanes, copolymers of ethyl acrylate, and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulfolene derivatives Exxon Necton-37™ (FN 1380) and Exxon Mineral Seal Oil™ (FN 3200).

Corrosion inhibitors useful for a driveline device include 1-amino-2-propanol, amines, triazole derivatives including tolyl triazole, dimercaptothiadiazole derivatives, octylamine octanoate, condensation products of dodecenyl succinic acid or anhydride and/or a fatty acid such as oleic acid with a polyamine.

A driveline device lubricating composition in different embodiments may have a composition as disclosed in the following table:

| | Embodiments (wt %) | | | |
|---|---|---|---|---|
| Additive | A | B | C | D |
| Product of Invention | 0.01 to 3 | 0.01 to 1 | 0.03 to 1 | 0.05 to 0.7 |
| Dispersant | 1 to 4 | 2 to 7 | 0 to 5 | 1 to 6 |
| Extreme Pressure Agent | 3 to 6 | 0 to 6 | 0 to 3 | 0 to 6 |
| Overbased Detergent | 0 to 1 | 0.01 to 2 | 0.5 to 6 | 0.01 to 2 |
| Antioxidant | 0 to 5 | 0.01 to 2 | 0 to 3 | 0 to 2 |
| Antiwear Agent | 0.5 to 5 | 0.01 to 3 | 0.5 to 3 | 0.01 to 3 |
| Friction Modifier | 0 to 5 | 0.01 to 5 | 0.1 to 1.5 | 0 to 5 |
| Viscosity Modifier | 0.1 to 70 | 0.1 to 15 | 1 to 60 | 0.1 to 70 |
| Any Other Performance Additive | 0 to 10 | 0 to 8 | 0 to 6 | 0 to 10 |
| Oil of Lubricating Viscosity | Balance to 100% | Balance to 100% | Balance to 100% | Balance to 100% |

Footnote:
The viscosity modifier in the table above may also be considered as an alternative to an oil of lubricating viscosity.
Column A may be representative of an automotive or axle gear lubricant.
Column B may be representative of an automatic transmission lubricant.
Column C may be representative of an off-highway lubricant.
Column D may be representative of a manual transmission lubricant.

A lubricating composition for a driveline device may have a sulphur-content of greater than 0.05 wt %, or 0.4 wt % to 5 wt %, or 0.5 wt % to 3 wt %, 0.8 wt % to 2.5 or to 3 wt %, 1 wt % to 2 or to 3 wt %, 1.5 wt % to 3 wt %, 2 wt % to 3 wt %, 0.075 wt % to 0.5 wt %, or 0.1 wt % to 0.25 wt % of the lubricating composition.

A lubricating composition for a driveline device may have a phosphorus content of 100 ppm to 5000 ppm, or 200 ppm to 4750 ppm, 300 ppm to 4500 ppm, or 450 ppm to 4000 ppm.

INDUSTRIAL APPLICATION

The driveline device contains at least one of gear oils, axle oils, drive shaft oils, traction oils, manual transmission oils, automatic transmission oils, or off highway oils (such as a farm tractor oil). In one embodiment the invention provides a method of lubricating a manual transmission that may or may not contain a synchronizer system. In one embodiment the invention provides a method of lubricating an automatic transmission. In one embodiment the invention provides a method of lubricating an axle.

An automatic transmission includes continuously variable transmissions (CVT), infinitely variable transmissions (IVT), toroidal transmissions, continuously slipping torque converter clutches (CSTCC), stepped automatic transmissions or dual clutch transmissions (DCT).

Automatic transmissions can contain continuously slipping torque converter clutches (CSTCC), wet start and shifting clutches and in some cases may also include metal or composite synchronizers.

Dual clutch transmissions or automatic transmissions may also incorporate electric motor units to provide a hybrid drive.

A manual transmission lubricant may be used in a manual gearbox which may be unsynchronized, or may contain a synchronizer mechanism. The gearbox may be self-contained, or may additionally contain any of a transfer gearbox, planetary gear system, differential, limited slip differential or torque vectoring device, which may be lubricated by a manual transmission fluid.

The gear oil or axle oil may be used in a planetary hub reduction axle, a mechanical steering and transfer gear box in utility vehicles, a synchromesh gear box, a power take-off gear, a limited slip axle, and a planetary hub reduction gear box.

The following examples provide illustrations of the invention. These examples are non-exhaustive and are not intended to limit the scope of the invention.

EXAMPLES

Preparative Examples 1 to 9 (Prep1 to Prep9)

a flange flask fitted with flange lid, overhead stirrer with PTFE gland, thermocouple, $N_2$ inlet and a Dean-Stark trap equipped with water cooled condenser is charged with A moles of glycolic acid, B moles of alcohol and C grams of toluene. The flask is warmed to 90° C. with stirring initiated once any solids melt then D moles of methanesulphonic acid (70 wt % in water) is charged in one portion. The temperature is maintained at 90° C. for 1-2 hours then heated 100-135° C. over 1-5 hours then held at 135° C. for 6-28 hours. The reaction is placed under vacuum to remove any residual toluene. The bulk residue is filtered through a porosity 3 sinter funnel. The product is a glycolate mixture. The Acid Number, TAN, (ASTM D664), and infrared spectroscopy are used to characterise the product. The amount of reagents used is summarised in the following table:

| Example | Alcohol | A moles of Glycolic acid | B moles of alcohol | C grams of toluene | D moles of methane sulphonic acid | TAN (mg KOH/g) |
|---|---|---|---|---|---|---|
| Prep 1 | Alfol 810 | 7.89 | 5.26 | 551 | 0.26 | 8.13[i] |
| Prep 2 | Alfol 810 | 8.27 | 4.14 | 500 | 0.3 | 0.38[b] |
| Prep 3 | Alfol 810 | 7.90 | 3.16 | 551 | 0.16 | 2.87[b] |
| Prep 4 | Alfol 1214 | 5.33 | 3.55 | 500 | 0.18 | 10.96[b] |
| Prep 5 | Alfol 1214 | 6.57 | 3.29 | 255 | 0.16 | 6.87[i] |

-continued

| Example | Alcohol | A moles of Glycolic acid | B moles of alcohol | C grams of toluene | D moles of methane sulphonic acid | TAN (mg KOH/g) |
|---|---|---|---|---|---|---|
| Prep 6 | Alfol 1214 | 9.25 | 3.70 | 550 | 0.05 | 22.1[b] |
| Prep 7 | Oleyl | 4.50 | 3.00 | 500 | 0.05 | 1.25[b] |
| Prep 8 | Oleyl | 3.73 | 1.86 | 300 | 0.10 | 3.47[b] |
| Prep 9* | Oleyl | 7.45 | 2.98 | 551 | 0.15 | 13.41[i] and 2.62[i] |

Footnote:
Alfol™ 810 and Alfol™ 1214 are commercially available alcohols believed to be predominantly C8-10 and C12-14, respectively.
Oleyl is oleyl alcohol
[b]is TAN measurement at buffer endpoint
[i]is TAN measurement made at point of inflection
*Prep 9 during titration to determine TAN gave two different TAN values during the one titration

Preparative Examples 10 to 15 (Prep10 to Prep15)

a flange flask fitted with flange lid, overhead stirrer with PTFE gland, thermocouple, $N_2$ inlet and a Dean-Stark trap equipped with water cooled condenser is charged with A moles of glycolic acid, B moles of amine and C grams of toluene. The flask is then warmed to 100° C. for 4-10 hours, and then from 100 to 140° C. over 8-13 hours. The flask is then held at 150° C. for 7-22 hours. The reaction is placed under vacuum to remove any residual toluene. The bulk residue is filtered through a porosity 3 sinter funnel and is then determined to be a glycolamide. The glycolamide is characterised by TAN and IR analytical methods. The amount of reagents used is summarised in the following table:

| Example | Amine | A moles of Glycolic acid | B moles of amine | C grams of toluene | TAN (mg KOH/g) |
|---|---|---|---|---|---|
| Prep 10 | Coco | 5.26 | 3.51 | 400 | 4.77[b] |
| Prep 11 | Coco | 6.25 | 3.12 | 400 | 3.76[i] |
| Prep 12 | Coco | 6.90 | 2.76 | 400 | 3.48[i] |
| Prep 13 | Oleyl | 1.97 | 1.31 | 200 | 6.57[b] |
| Prep 14 | Oleyl | 2.44 | 1.22 | 200 | 7.00[b] |
| Prep 15 | Oleyl | 2.63 | 1.05 | 225 | 7.08[i] |

Footnote:
Coco is cocoamine
Oleyl is oleylamine
[b]is TAN measurement made at buffer endpoint.
[i]is TAN measurement made at point of inflection

Preparative Example 16 (Prep16)

1 liter flange flask is fitted with PTFE gasket, flange lid, nitrogen inlet providing a nitrogen flow of 200 $cm^3$/min, thermocouple, overhead stirrer with PTFE gland and Dean-Stark trap fitted with double wall water cooled condenser. The flask is charged with glycolic acid (105.77 g), toluene (250 g), 1,2-dodecanediol (190.9 g) and methanesulfonic acid (6.45 g). The reaction is warmed to 105° C., stirring is initiated at 50° C. at 200 rpm and increased to 350 rpm as the reaction becomes homogeneous. As the temperature approaches 105° C. a milky solution begins to collect and separate in the Dean-Stark trap. The first 100 ml fluid is collected and discarded. The temperature is increased to 135° C. and reflux is sustained for 18 hours. The flask is equipped for vacuum stripping and vacuum is gradually increased to 50 mm Hg (equivalent to 6.6 kPa) and held for 1 hour. The flask contents are cooled to 70° C. and vacuum is released. The coloured viscous oil is transferred whilst hot to produce 248.97 g of product.

A series of sixteen 80W-90 gear oil lubricants are prepared containing 0.15 wt % of 2,5-bis(tert-nonyldithio)-1,3,4-thiadiazole, 4.43 wt % of sulphurised isobutylene, 0.35 wt % of oleylamine, and 1.0% of an amine salt of an alkylphosphoric acid. Each lubricant 1 to 16 contains 0.05 wt % of a product of Prep1 to Prep16 respectively (Lubricant 1 contains 0.05 wt % of Prep1, and Lubricant 16 contains 0.05 wt % of Prep16). Similarly, an 80W-90 gear oil comparative lubricant (CE1) is prepared containing 0.15 wt % of 2,5-bis(tert-nonyldithio)-1,3,4-thiadiazole, 4.43 wt % of sulphurised isobutylene, 0.35 wt % of oleylamine, and 1.0% of an amine salt of an alkylphosphoric acid.

The gear oils are evaluated using the L-37 test, used to evaluate load carrying wear in an axle under high speed/low torque and low speed/high torque conditions. This test is performed according to a modified lubrited version of the ASTM-D6121-05a procedure. The lubrited procedure differs from the ASTM test by employing a non-lubrited gear batch V1L500/P4T813. The gear batch requires the test to operate with a reduction of 13% to the contact stress level. The reduced contact stress level is obtained by lowering the dynamometer torque 30% during the gear test phase. Typically, better results are obtained for lubricants that have higher ratings in ring and pinion gears. Lubricant 9, Lubricant 16, and the comparative lubricant (CE1) are evaluated and the results are presented in the following table:

| Parameter Rated | ASTM D6121-05a Rating | | | |
|---|---|---|---|---|
| | Pass Rating | Lubricant 9 | Lubricant 16 | Lubricant CE1 |
| | Ring Gear | | | |
| Final Wear Rating | 5 | 9 | 9 | 5 |
| Final Surface Fatigue Rippling | 8 | 10 | 10 | 9 |
| Final Surface Fatigue Ridging | 8 | 10 | 10 | 4 |
| Final Surface Fatigue Pitting and Spalling Merit | 9.3 | 9.9 | 9.9 | 9.9 |
| Final Surface Fatigue Scoring | 10 | 10 | 10 | 10 |
| | Pinion Gear | | | |
| Final Wear Rating | 5 | 8 | 7 | 5 |
| Final Wear Rippling | 8 | 10 | 10 | 9 |
| Final Wear Ridging | 8 | 10 | 10 | 5 |
| Final Wear Scoring | 9.3 | 9.9 | 9.9 | 9 |
| Final Pitting and Spalling Merit | 10 | 10 | 10 | 10 |

The results indicate that the lubricating composition disclosed herein is employed to lubricate a driveline device and capable of providing at least one of antiwear performance, or friction modification.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs [0137] to [0141] of published application US 2010-0197536.

As used herein, a "residue" of a hydroxy-carboxylic acid (or of another reacted chemical) means that portion of the chemical that remains after a condensation to form part of an ester or other condensation product. For instance, in Formula 1, an example of a residue of a hydroxy-carboxylic acid is shown by the substructure:

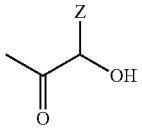

Reference to "repeat units" of a residue of a hydroxy-carboxylic acid (or another material) refers to such units either repeating in a chain, as in the self-condensation of a hydroxy-acid (as shown in Formula 1, where n is non-zero); or alternatively to multiple such units separately attached to a core portion of a molecule (as shown in Formula 2), or mixtures of such modes of repeating.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of lubricating a driveline device comprising supplying to the driveline device a lubricating composition comprising:

(a) an oil of lubricating viscosity and (b) 0.01 wt % to 3 wt % of a compound having 2 to 20 repeat units of a residue of a hydroxy-carboxylic acid, wherein the compound is obtained/obtainable by a reacting a hydroxy-carboxylic acid with a hydrogen bonding donor capable of forming an ester or amide group with a carboxylic acid group of the hydroxy-carboxylic acid, wherein the hydrogen bonding donor is selected from at least one member of the group consisting of an alcohol, a primary mono-amine and a secondary mono-amine, wherein the hydroxy-carboxylic acid is a hydroxy-substituted carboxylic acid having 2 to 10 carbon atoms, wherein, when the hydrogen bonding donor is a mono-ol, the mole ratio of mono-ol to the hydroxy-carboxylic acid ranges from 1:1.1 to 1:10, and wherein the driveline device is an axle, a gearbox or a manual transmission.

2. The method of claim 1, wherein the compound has 2 to 5 hydroxy-carboxylic acid residues.

3. The method of claim 1, wherein the hydroxy-carboxylic acid is a hydroxy-substituted carboxylic acid having 2 to 3 carbon atoms.

4. The method of claim 1, wherein the hydroxy-carboxylic acid is non-aromatic.

5. The method of claim 1, wherein the hydroxy-carboxylic acid is aromatic.

6. The method of claim 1, wherein the hydroxy-carboxylic acid has 1 to 6 hydroxyl groups.

7. The method of claim 1, wherein the hydroxy-carboxylic acid contains two hydroxyl groups and two or three carboxylic acid moieties.

8. The method of claim 1, wherein the hydroxy-carboxylic acid has two hydroxyl groups.

9. The method of claim 1, wherein the hydroxy-carboxylic acid is selected from the group consisting of a glycolic acid, a malic acid, a salicylic acid, a mandelic acid, or a lactic acid, a tartaric acid, a citric acid, and mixtures thereof, and derivatives thereof.

10. The method of claim 1, wherein the hydroxy-carboxylic acid is glycolic acid.

11. The method of claim 1, wherein the hydroxy-carboxylic acid is tartaric acid.

12. The method of claim 1, wherein the compound having 2 to 20 repeat units of a residue of a hydroxy-carboxylic acid is present 0.05 wt % to 0.8 wt % of the lubricating composition.

13. The method of claim 1, wherein the lubricating composition further comprises at least one organo-sulphide selected from the group consisting of a polysulphide, a thiadiazole compound, or mixtures thereof.

14. The method of claim 13, wherein the organo-sulphide is present in a range of 0.25 wt % to 6 wt %; of the lubricating composition.

15. The method of claim 1, wherein the lubricating composition has a sulphur-content of 0.5 wt % to 3 wt % of the lubricating composition.

16. The method of claim 1, wherein the manual transmission does contain a synchronizer system.

17. The method of claim 1, wherein the manual transmission does not contain a synchronizer system.

18. The method of claim 1, wherein the hydrogen bonding donor is a mono-alcohol.

19. The method of claim 18, wherein the mole ratio of mono-ol to the hydroxy-carboxylic acid ranges from 1:1.1 to 1:5.

20. The method of claim 19, wherein the mole ratio of mono-ol to the hydroxy-carboxylic acid ranges from 1:1.2 to 1:2.5.

* * * * *